US006534151B2

(12) United States Patent
Merker

(10) Patent No.: US 6,534,151 B2
(45) Date of Patent: Mar. 18, 2003

(54) CREPED WIPING PRODUCT CONTAINING BINDER FIBERS

(75) Inventor: Joseph F. Merker, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 115 days.

(21) Appl. No.: 09/829,156

(22) Filed: Apr. 9, 2001

(65) Prior Publication Data

US 2001/0015251 A1 Aug. 23, 2001

Related U.S. Application Data

(63) Continuation of application No. 08/842,853, filed on Apr. 17, 1997, now Pat. No. 6,214,146.

(51) Int. Cl.[7] ..... B32B 3/28

(52) U.S. Cl. ..... 428/154; 428/153; 428/152; 162/111; 162/112; 162/113; 442/385; 442/412; 442/409

(58) Field of Search ..... 428/152, 153, 428/154; 162/11, 112, 113; 442/385, 412, 409

(56) References Cited

U.S. PATENT DOCUMENTS

| | | | | |
|---|---|---|---|---|
| 3,014,832 A | | 12/1961 | Donnelly | |
| 3,565,756 A | | 2/1971 | Kashiwabara et al. | |
| 3,846,228 A | | 11/1974 | Ely et al. | |
| 3,879,257 A | | 4/1975 | Gentile et al. | |
| 4,104,115 A | | 8/1978 | Prouse et al. | |
| 4,134,948 A | | 1/1979 | Baker, Jr. | |
| 4,166,001 A | * | 8/1979 | Dunning et al. | 162/111 |
| 4,208,459 A | | 6/1980 | Becker et al. | |
| 4,429,014 A | * | 1/1984 | Isner et al. | 15/209.1 |
| 4,487,796 A | * | 12/1984 | Lloyd et al. | 156/183 |
| 4,790,907 A | | 12/1988 | Mallen et al. | |
| 5,009,747 A | | 4/1991 | Viazmensky et al. | |
| 5,094,717 A | | 3/1992 | Manning et al. | |
| 5,137,600 A | | 8/1992 | Barnes et al. | |
| 5,397,435 A | | 3/1995 | Ostendorf et al. | |
| 5,466,318 A | | 11/1995 | Björk | |
| 5,538,595 A | | 7/1996 | Trokhan et al. | |
| 5,674,590 A | * | 10/1997 | Anderson et al. | 162/111 |
| 5,989,682 A | * | 11/1999 | Anderson | 156/209 |
| 6,080,466 A | | 6/2000 | Yoshimura et al. | |

FOREIGN PATENT DOCUMENTS

| | | |
|---|---|---|
| DE | 2528311 | 1/1976 |
| DE | 2750590 | 5/1979 |
| EP | 0465203 A1 | 1/1992 |
| JP | 481443 | 1/1973 |
| WO | WO9314267 | 7/1993 |

OTHER PUBLICATIONS

PCT International Search Report Jun. 8, 1998.

* cited by examiner

*Primary Examiner*—William P. Watkins, III
(74) *Attorney, Agent, or Firm*—Dority & Manning, P.A.

(57) ABSTRACT

The present invention is generally directed to wiping products having great softness and strength. The wiping products are made from a web of material containing binder fibers alone or in combination with pulp fibers. Once the web is formed, the web is adhered to a creping surface and creped. According to the present invention, the web may be creped once or creped multiple times. Of particular advantage, the web can be adhered to a creping surface through the use of the binder fibers without the use of an adhesive.

17 Claims, 2 Drawing Sheets

CREPED WIPING PRODUCT CONTAINING BINDER FIBERS

This application is a continuation of Ser. No. 08/842,853 filed Apr. 17, 1997, now U.S. Pat. No. 6,214,146.

FIELD OF THE INVENTION

The present invention is generally directed to soft, solvent resistant and elastic wiping products and to a method for making the wiping products. More particularly, the present invention is directed to wiping products made from a web which has been creped at least once and which contains thermally bonded synthetic fibers. By including the thermally bonded fibers within the web, the wiping product can be made without the use of latex adhesives as were conventionally used in the past.

BACKGROUND OF THE INVENTION

Disposable wiper products such as paper towels, industrial wipers, and other similar products are designed to include several important properties. For example, the products should have good bulk, a soft feel and should be highly absorbent. The products should also have good strength even when wet and should resist tearing. The wiping products should also have good stretch characteristics, should be abrasion resistant, and should not deteriorate in the environment in which they are used.

In the past, many attempts have been made to enhance and increase certain physical properties of disposable wiping products. Unfortunately, however, when steps are taken to increase one property of a wiping product, other characteristics of the product may be adversely affected. For instance, in cellulosic based wiping products, softness is typically increased by decreasing or reducing cellulosic fiber bonding within the paper product. Inhibiting or reducing fiber bonding, however, adversely affects the strength of the paper web.

One particular process that has proven to be very successful in producing paper towels and other wiping products is disclosed in U.S. Pat. No. 3,879,257 to Gentile, et al., which is incorporated herein by reference in its entirety. In Gentile, et al., a process is disclosed for producing soft, absorbent, single ply fibrous webs having a laminate-like structure that are particularly well suited for use as wiping products.

The fibrous webs disclosed in Gentile, et al. are formed from an aqueous slurry of principally lignocellulosic fibers under conditions which reduce interfiber bonding. A bonding material, such as a latex elastomeric composition, is applied to a first surface of the web in a spaced-apart pattern. In particular, the bonding material is applied so that it covers from about 50% to about 60% of the surface area of the web. The bonding material provides strength to the web and abrasion resistance to the surface. Once applied, the bonding material can penetrate the web preferably from about 10% to about 40% of the thickness of the web.

The bonding material can then be similarly applied to the opposite side of the web for further providing additional strength and abrasion resistance. Once the bonding material is applied to the second side of the web, the web can be brought into contact with a creping surface. Specifically, the web will adhere to the creping surface according to the pattern to which the bonding material was applied. The web is then creped from the creping surface with a doctor blade. Creping the web greatly disrupts the fibers within the web, thereby increasing the softness, absorbency, and bulk of the web.

In one of the preferred embodiments disclosed in Gentile, et al., both sides of the paper web are creped after the bonding material has been applied. Gentile, et al. also discusses the use of chemical debonders to treat the fibers prior to forming the web in order to further reduce interfiber bonding and to increase softness and bulk.

The processes as disclosed in Gentile, et al. have provided great advancements in the art of making disposable wiping products. The products, however, tend to be somewhat expensive to produce due in part to the cost of the latex bonding material that is applied to each side of the web and due to the equipment and energy requirements needed to apply and cure the bonding material. Further, besides being one of the more expensive components of the product, in some applications, the latex bonding material when cross-linked and cured may form formaldehyde. When formaldehyde is formed, precautions must be taken to ensure that the formaldehyde does not create any health risks and is not released to the environment.

Thus, it would be desirable if disposable wiping products having properties similar to those disclosed in Gentile, et al. could be produced without using a latex bonding material. More particularly, a need exists for a method of producing wiping products having good softness, bulk, absorbency and strength that can be made without having to use a latex adhesive. A need also exists for a method of producing wiping products that will not degrade significantly when exposed to solvents and chemicals as will be described in more detail hereinafter.

SUMMARY OF THE INVENTION

The present invention recognizes and addresses the foregoing drawbacks, and deficiencies of prior art constructions and methods.

Accordingly, it is an object of the present invention to provide an improved method for producing wiping products.

Another object of the present invention is to provide wiping products that can be made without the use of a latex bonding material or adhesive.

It is another object of the present invention to provide a method for producing wiping products that are soft and absorbent while having good strength and stretch characteristics when either wet or dry.

Still another object of the present invention is to provide a wiping product that contains binder fibers that thermally bond together when heated under pressure.

It is another object of the present invention to provide a method for producing wiping products by incorporating into a paper web binder fibers which, when heated, adhere to a creping surface for allowing the paper web to be creped without the use of an adhesive.

Another object of the present invention to provide a method for producing wiping products that do not have to be fed through a high temperature curing oven when being produced.

These and other objects of the present invention are achieved by providing a method for producing wiping products that includes first providing a web of material that contains binder fibers. The binder fibers are capable of thermally bonding together when heated above a softening temperature and pressed together.

The method further includes the step of adhering one side of the web to a creping surface. In particular, the web is placed in contact with the creping surface while the web is at a temperature greater than the softening temperature of the binder fibers but at a temperature insufficient to melt the fibers. The first side of the web is then creped from the creping surface causing interfiber bonding to occur between the binder fibers, while also increasing softness, absorbency and bulk of the web.

In one embodiment, the web is adhered to the creping surface through the use of the binder fibers without using an adhesive, such as a latex adhesive. The binder fibers can comprise polyolefin fibers, such as polyethylene fibers or polypropylene fibers. The binder fibers can also be bicomponent fibers including a core polymer surrounded by a sheath polymer. When using bicomponent fibers, the core polymer should have a melting temperature higher than the melting temperature of the sheath polymer.

The binder fibers can be present within the web in an amount of at least about 5% by weight, and particularly in an amount of from about 5% by weight to about 60% by weight. Besides binder fibers, the web can also include pulp fibers, such as softwood fibers. In order to cause the binder fibers to adhere to the creping surface, the creping surface can be heated to a temperature of from about 290° F. to about 325° F.

In one alternative embodiment, the method can further include the step of embossing a pattern into the web as the web is adhered to the creping surface.

These and other objects of the invention are also achieved by providing a method for producing wiping products including the steps of first providing a web of material containing binder fibers capable of thermally bonding together when heated above a softening temperature and pressed together. The binder fibers can be made containing either polyethylene or polypropylene. The binder fibers are present within the web in an amount of at least about 5% by weight.

A first side of the web is contacted with a first heated creping surface. The creping surface is heated to a temperature sufficient to cause the binder fibers contained in the web to adhere to the surface but to a temperature insufficient to melt the binder fibers. Once adhered to the creping surface, the web is creped from the surface.

The second side of the web is then similarly contacted with a second heated creping surface. The second creping surface is also heated to a temperature sufficient to cause the binder fibers contained in the web to adhere to the surface but at a temperature insufficient to melt the fibers. Once adhered to the second creping surface, the second side of the web is creped for producing the wiping product.

Of particular advantage, the web of material can be adhered to both the first creping surface and to the second creping surface without using an adhesive. In one embodiment, a first press roll can be used to place the first side of the web into contact with the first creping surface and a second press roll can be used to place the second side of the web into contact with the second creping surface. The first press roll and the second press roll exert pressure on the web in an amount sufficient to adhere the web to the creping surfaces. In one embodiment, at least one of the press rolls can emboss a pattern into the web as the web is adhered to one of the creping surfaces.

Creping each side of the web increases the web's bulk and absorbency, as well as its softness and compressibility. According to the present invention, the creping action also serves to cause the heated binder fibers to bond together, thus also increasing the strength and elasticity of the web.

The wiping products produced according to the above processes can have a basis weight of from about 15 pounds per 2,880 square feet to about 100 pounds per 2,880 square feet.

Other objects, features, and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
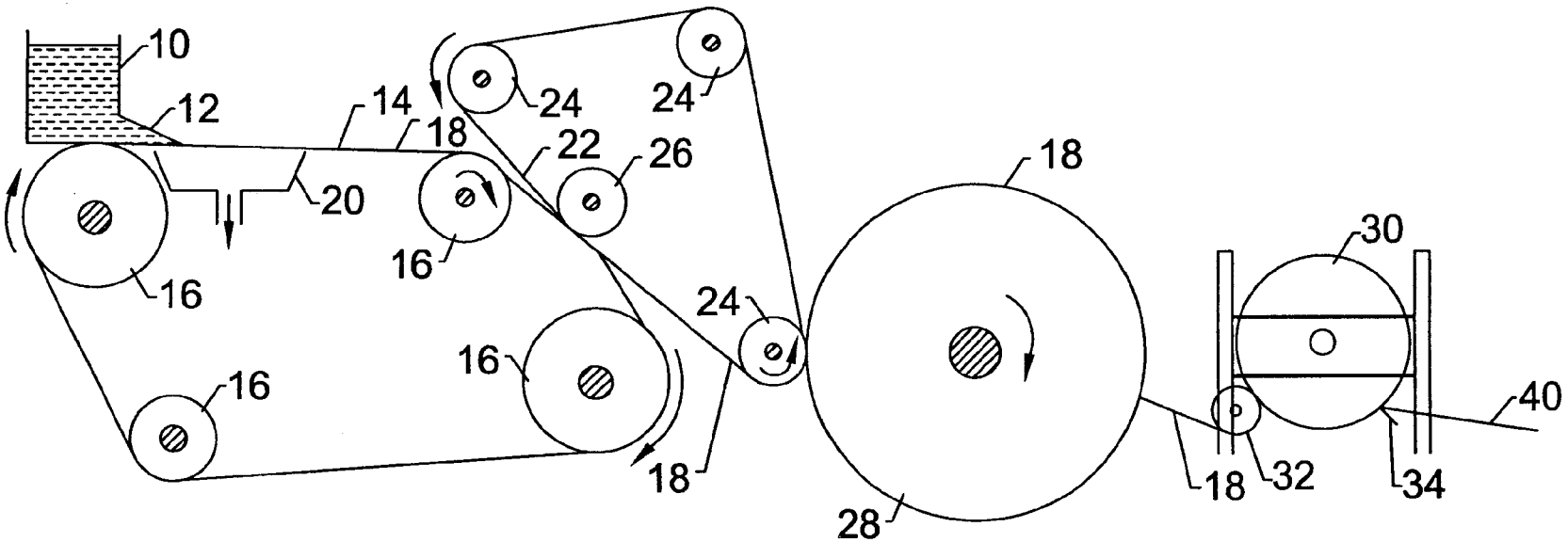
FIG. 1 is a schematic diagram illustrating one embodiment of the process of the present invention.

Repeat use of reference characters in the present specification and drawings is intended to represent same or analogous features or elements of the present invention.

DETAILED DESCRIPTION OF PREFERRED EMBODIMENTS

It is to be understood by one of ordinary skill in the art that the present discussion is a description of exemplary embodiments only, and is not intended to limit the broader aspects of the present invention which broader aspects are embodied in the exemplary construction.

In general, the present invention is directed to a method for producing wiping products containing a preselected amount of binder fibers. As used herein, a binder fiber refers to a fiber that will thermally bond with other fibers when heated and pressed together. Binder fibers, which are typically synthetic fibers, when heated above a softening point will flow under pressure, while retaining their structural characteristics. By including binder fibers within the wiping product of the present invention, the product can be made without the use of latex adhesives, as was necessary in many conventional prior art processes.

More particularly, the wiping products of the present invention are made from a web of material containing binder fibers. The binder fibers are added to the web in an amount sufficient to adhere the web to a heated creping surface without the use of a latex adhesive. According to the present invention, the web can be creped on one side or, alternatively, can be creped on both sides of the web.

There are many benefits and advantages to being able to produce creped wiping products without using a latex adhesive. For instance, as described above, latex bonding materials account for a substantial part of the cost in producing conventional paper based wipers and towels. Many latex binding materials can also form formaldehyde during use which requires that they be applied only under carefully controlled conditions in order to prevent any health risks and to ensure that the formaldehyde is not released to the environment. Precautions also need to be taken to ensure that the resulting product does not contain substantial amounts of formaldehyde.

The ability to make wiping products without using a latex adhesive also greatly simplifies the process by which the products are made. For example, if a latex adhesive is not used, print systems contained in the process for applying the adhesive can be eliminated from the process. Also, high temperature curing ovens that are used to cure latex adhesives after they have been applied to a paper web are no longer necessary in the process of the present invention. Thus, besides not having to purchase a latex adhesive, the process of the present invention generally requires less equipment and has less energy requirements in comparison to conventional processes.

Besides eliminating dependance upon latex adhesives and bonding materials, the binder fibers incorporated into the wiping products of the present invention increase the wet and dry strength of the product. More particularly, the wiping products of the present invention have good stretch characteristics and are tear resistant, while remaining bulky and soft. The wiping products have good absorbency characteristics, are abrasion resistant, and have good elastic properties. Of particular advantage, since binder fibers are included within the wiping products, the products are much more resistant to degradation when exposed to solvents and chemicals than conventional latex containing products.

The process of the present invention generally involves first forming a web of material containing the binder fibers. The web can be made exclusively from the binder fibers, but preferably contains binder fibers in combination with pulp fibers, such as softwood fibers, in order to increase absorbency.

The amount of binder fibers contained within the web will depend upon the particular application. The binder fibers should be present in an amount sufficient for the web to adhere to a heated creping surface without the use of the latex adhesive as will be described in more detail hereinafter. Thus, for most applications, it is believed that the binder fibers should be present in an amount of about at least 5% by weight.

Once enough binder fibers are added to the web in order to permit the web to adhere to a heated creping surface, a further amount of binder fibers can be added in order to increase the strength of the web. As strength increases, however, the absorbency of the web tends to decrease. Thus, although the web can be made entirely from the binder fibers, for most applications the binder fibers should be present within the web in an amount from about 5% to about 60% by weight, and particularly from about 10% to about 40% by weight.

The type of pulp fibers combined with the binder fibers in producing the wiping product of the present invention can vary and is generally not critical. in one preferred embodiment, however, Northern softwood kraft fibers are used. Northern softwood kraft fibers have a fiber length of from about 1.8 mm to about 3 mm. As described above, the pulp fibers are primarily incorporated into the product for their absorbency characteristics.

In forming a web of material according to the present invention, the binder fibers and the pulp fibers can be mixed homogeneously or can be combined in layers to form a stratified web. In either embodiment, a sufficient amount of binder fibers should be present at the surface of the web in order to facilitate attachment of the web to a heated surface when creped.

The manner in which the web of material is formed for use in the process of the present invention may also vary depending upon the particular application. For instance, in one embodiment, the web can be formed in a wet lay process according to convention paper making techniques. In a wet lay process, the binder fibers and pulp fibers are combined with water to form an aqueous suspension. The aqueous suspension is spread onto a wire or felt and dried to form the web.

Alternatively, the web of material used in the process of the present invention can be air formed. In this embodiment, air is used to transport the fibers and form a web.

The length of the binder fibers used in the process of the present invention will generally depend upon the technique used to form the web of material. For most applications, the fiber length should be as long as possible to promote strength. In wet lay processes, the binder fibers, for most applications, can have a length of from about one fourth of an inch to about one half of an inch. Longer or shorter fibers, however, may be used.

Air formed webs, on the other hand, are typically capable of processing longer fibers than most wet lay processes. Thus, when the web of material is made according to an air lay process, in most applications longer binder fibers can be used.

When the web of material made in accordance with the present invention contains pulp fibers, the pulp fibers form hydrogen bonds and bond together during formation of the web, especially during wet lay processes. In some applications, is desirable to limit the amount of bonding that occurs between the pulp fibers in order to increase the softness and bulk of the web. In this regard, the fiber furnish used to form the base web can be treated with a chemical debonding agent during formation of the web. The chemical debonding agent decreases interfiber bond strength.

Suitable debonding agents that may be used in the present invention include cationic debonding agents such as fatty dialkyl quaternary amine salts, monofatty alkyl tertiary amine salts, primary amine salts, and unsaturated fatty amine salts. Other suitable debonding agents are disclosed in U.S. Pat. No. 5,529,665 to Kaun, which is incorporated herein by reference.

In one embodiment, the debonding agent used in the process of the present invention is an organic quaternary ammonium chloride and particularly a silicone based amine salt of a quaternary ammonium chloride. The amount of debonding agent added to the mixture of fibers will depend upon the amount of pulp fibers present in the mixture. The debonding agent can be added in an amount from about 0.1% to about 1% by weight, based on the total weight of fibers present within the mixture.

As described above, the binder fibers used in the process of the present invention fuse together when heated above a softening temperature and pressed together. The fibers act as an adhesive within the web giving the web strength, stretchability, and elasticity. Suitable binder fibers for use in the process of the present invention include, for instance, various synthetic fibers, such as fibers made from polyolefins. For example, in one preferred embodiment, the binder fibers are made from polyethylene or polypropylene. These fibers will typically fuse and bond together within a temperature range of from about 290° F. to about 325° F. without melting. Within this temperature range, the fibers will soften and bond together when pressure is applied, while still retaining their structural characteristics.

In one alternative embodiment, bicomponent fibers may be used in the process. Bicomponent fibers refer to fibers containing a core polymer surrounded by a sheath polymer. The sheath polymer should have a lower melting temperature than the core polymer. For instance, in most applications, a bicomponent fiber should be chosen in which the sheath polymer will soften and cause the fibers to bond together without causing the core polymer to soften or melt.

In one embodiment, bicomponent fibers used in the present invention can include a sheath polymer made from polyethylene or polypropylene, which surrounds a core polymer made from polyester or nylon. For example, such commercially available bicomponent fibers can be obtained from the Hoechst Cellanese Company under the tradename CELBOND.

Referring to FIG. 1, one embodiment of a process for making wiping products in accordance with the present invention is illustrated. In this embodiment, a fiber suspension 10 is formed into a web of material according to a wet lay process. As described above, in some applications, fiber suspension 10 may contain a debonding agent.

Fiber suspension 10 is contained within a headbox 12. Headbox 12 is in communication with a forming fabric 14 which is supported and driven by a plurality of guide rolls 16. Headbox 12 spreads out the fiber suspension onto fabric 14 where the suspension is formed into a web 18. In this embodiment, a vacuum box 20 is disposed beneath forming fabric 14 and is adapted to remove water from the fiber furnish to assist in forming web 18.

From forming fabric 14, formed web 18 is transferred to a second fabric 22, which may be either a wire or a felt. Fabric 22 is supported for movement around a continuous path by a plurality of guide rolls 24. Also included is a pickup roll 26 designed to facilitate transfer of web 18 from fabric 14 to fabric 22. Preferably, the speed at which fabric 22 is driven is approximately the same speed at which fabric 14 is driven so that movement of web 18 through the system is consistent.

From fabric 22, web 18, in this embodiment, is transferred to the surface of a rotatable heated dryer drum 28, such as a Yankee dryer. Web 18 is lightly pressed into engagement with the surface of dryer drum 28 by the bottom guide roll 24. As web 18 is carried through a portion of the rotational path of the dryer surface, heat is imparted to the web causing most of the moisture contained within the web to be evaporated.

In an alternative embodiment, web 18 can be through dried instead of being placed on a dryer drum. A through drier accomplishes the removal of moisture from the web by passing air through the web without applying any mechanical pressure. Through drying can increase the bulk and softness of the web.

From dryer drum 28, as shown in FIG. 1, web 18 is pressed into engagement with a creping dryer 30 by a press roll 32. In accordance with the present invention, creping dryer 30 is heated to a temperature sufficient to soften the binder fibers contained within the web. Creping drum 30, however, should not be heated to a temperature that will melt the binder fibers.

More particularly, press roll 32 in combination with creping dryer 30 apply a sufficient amount of heat and pressure to web 18 for causing the web to adhere to the creping dryer surface without the use of a latex adhesive. Specifically, web 18 will adhere to creping dryer 30 wherever binder fibers are present at the surface of the web. Once adhered to creping dryer 30, web 18 can be removed from the dryer by a creping blade 34, forming a wiping product 40.

Creping the web from the creping dryer produces a number of significant changes in the web. On one hand, creping the web imparts a series of fine fold lines to the portions of the web which adhere to the creping surface. The creping action causes pulp fibers contained in the web to puff up and spread apart, increasing the softness and bulk of the web.

According to the present invention, creping web 18 also causes the binder fibers contained within the web to bond together. Specifically, as described above, when web 18 engages creping blade 34, the web is already heated to a temperature sufficient to soften the binder fibers. Once heated, the web is then impacted upon creping blade 34. During the creping operation, pressure is exerted on the web as it is creped from the surface of the dryer. This pressure causes interfiber bonding to occur between the binder fibers. Thus, according to the process of the present invention, the creping operation not only increases bulk and softness but also increases the strength and elasticity of the web.

In one embodiment, when web 18 contains binder fibers made from either polyethylene or polypropylene, creping dryer 30 is heated to a temperature from about 290° F. to about 325° F. and particularly from about 290° F. to about 315° F. in order to cause the web to adhere to the drum. Preferably, press roll 32 exerts from about 15 pounds per linear inch to about 60 pounds per linear inch of pressure on the web as it is adhered to the drum.

Thus, instead of using a latex adhesive, web 18 is adhered to creping dryer 30 through the use of a binder fiber that is heated above its softening temperature but below its melting temperature. As described above, eliminating the use of a latex adhesive to produce the wiping products provides various advantages. For instance, wiping product 40 can be produced without containing any residual formaldehyde which may be produced when using an adhesive. Of particular significance, wiping product 40 can be produced according to the process of FIG. 1 without print machines for applying adhesives and without high temperature cure ovens that are used to cure adhesives applied to the web.

In general, press roll 32 can have a smooth surface for adhering the entire surface of web 18 to creping dryer 30. Alternatively, however, an embossing pattern can be incorporated into press roll 32. In this embodiment, press roll 32 can be used to emboss a pattern into web 18. For instance, the pattern can be in the form of discrete shapes or can comprise a reticular net-like design.

When a pattern is embossed into web 18, the web is adhered to creping dryer 30 according to the pattern. Thus, only those portions of the web that have been embossed by a raised portion on press roll 32 will be creped from the surface of creping dryer 30.

Figure 2:
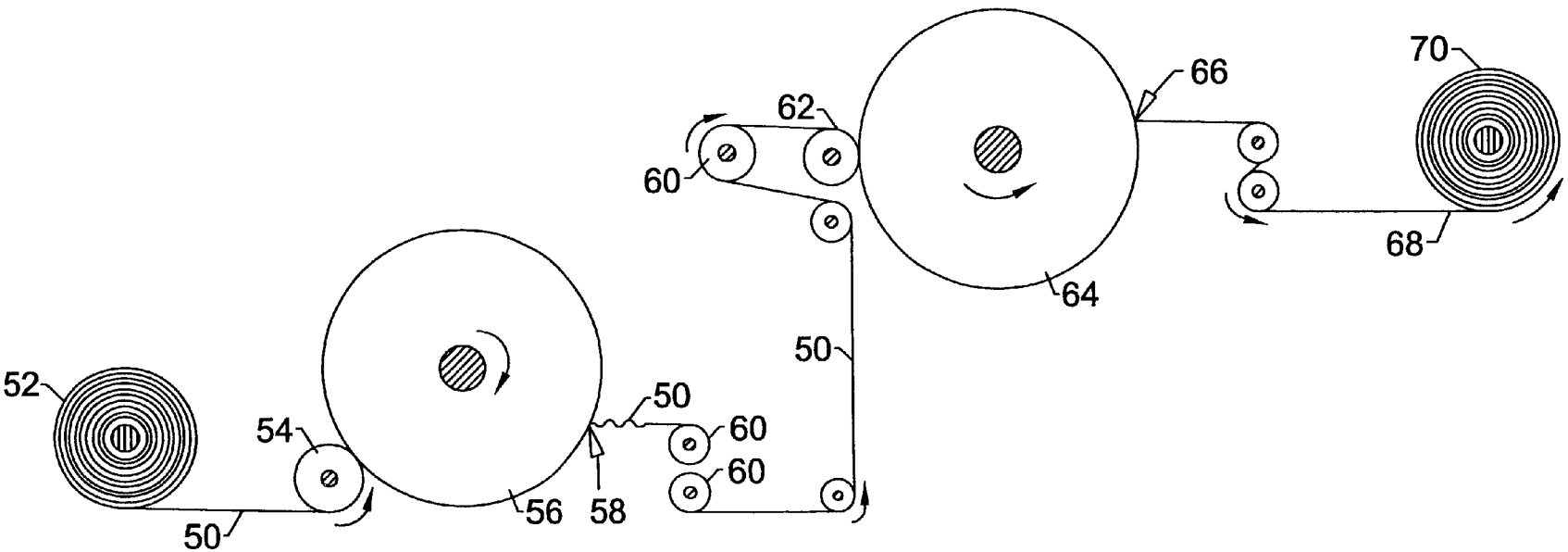
FIG. 2 is a schematic diagram of an alternative embodiment of the process of the present invention.

Referring to FIG. 2, an alternative embodiment of a process in accordance with the present invention is illustrated. In this embodiment, as opposed to the embodiment illustrated in FIG. 1, a web of material 50 containing binder fibers is creped twice, once on each side of the web. Also, the process illustrated in FIG. 2 is an off-line process in that a roll of previously formed material 52 is fed into the system. In FIG. 1, on the other hand, a continuous process is illustrated by which a fiber suspension is formed into a web and then the web is formed into a wiping product. It should be understood, however, that the embodiment illustrated in FIG. 2 can also be incorporated into a continuous process if desired.

Referring to FIG. 2, web 50 containing binder fibers is first contacted with a press roll 54, which may be heated. Press roll 54 applies pressure to web 50 and guides it onto a first creping roll 56. Press roll 54 can either have a smooth surface or can include an embossing pattern which may be embossed into the web.

Similar to the embodiment illustrated in FIG. 1, first creping roll 56 is heated to a temperature that will soften the binder fibers contained within web 50 without melting the fibers. In this manner, web 50 is adhered to first creping roll 56 without the use of a creping adhesive. Once adhered to drum 56, web 50 is brought into contact with a first creping blade 58. Specifically, web 50 is removed from first creping roll 56 by the action of creping blade 58, performing a first controlled crepe on the web. If web 58 has been embossed by press roll 54, creping blade 58 crepes the web according to the embossed pattern.

As described above, the creping operation not only increases the bulk and softness of the web but also increases the strength and elasticity of the web by causing the binder fibers to bond together.

Once creped, web 50 is advanced by pull rolls 60 into engagement with a second press roll 62. Press roll 62, which can either have a smooth surface or can include an embossed pattern, applies pressure to web 50 and guides the web onto a second creping drum 64. Specifically, the side of the web that was not creped by first creping blade 58 is adhered to drum 64.

Second creping drum 64 is heated applying sufficient temperature to web 50 to cause the binder fibers contained within the web to soften without causing the fibers to melt. The binder fibers contained within the web cause the web to adhere to the drum's surface without the use of a creping adhesive. The second side of the web is then creped from the drum by a second creping blade 66.

Once the web is creped for a second time, a wiping product 68 made in accordance with the present invention is produced. As shown, wiping product 68 can be rolled into a roll of material 70. In one embodiment, the process illustrated in FIG. 2 can further include a cooling station for cooling the web after contacting second creping roll 64. For example, the cooling station can include refrigerated cooling rolls through which the web is passed.

Once wound into a roll of material 70, the wiping product of the present invention can then be transferred to another location and cut into commercial size sheets for packaging.

Although the present invention is directed to a process for creping a web at least once without the use of a creping adhesive, during certain applications it may be desirable to apply an adhesive to the web. For instance, a latex adhesive may be applied to the web in order to further promote the strength of the web or to prevent the wiping product from producing lint.

Wiping products made according to the above described processes provide many advantages and benefits over various conventional wiping products made in the past. The wiping products made according to the present invention have good strength when either wet or dry, have improved solvent resistance, have good tear resistance, have good elastic properties, are abrasion resistant, and have good softness characteristics. The basis weight of the wiping products can range anywhere from about 15 pounds per 2,880 square feet (ream) to about 100 pounds per ream.

The present invention may be better understood with reference to the following example.

EXAMPLE

The following example was conducted to demonstrate that a web according to the present invention can be creped from a creping surface without the use of a bonding material, such as a latex adhesive.

An air formed web containing 50% by weight polypropylene binder fibers was pressed onto a creping drum heated to a temperature of 280° F. Without using an adhesive, it was discovered that the web adhered to the drum. The web was then creped successfully from the drum using a creping blade. It was observed that the creping operation not only increased the bulk and softness of the web but also caused bonding to occur between the binder fibers.

The web of material as described above was then also adhered and creped from a drum heated to 290° F. and from a drum heated to 295° F. During these two trials, similar results were obtained in that successful bonding occurred between the web and the drum allowing the web to be creped from the drum.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A wiping product comprising:

a creped, stratified web of material that includes an inner fibrous layer positioned between a first outer fibrous layer and a second outer fibrous layer, said web containing pulp fibers and thermally bonded binder fibers, said binder fibers being present in at least said first and said second outer layers so that said binder fibers constitute between about 5% to about 60% by weight of said web, said web being formed without using a creping adhesive.

2. A wiping product as defined in claim 1, wherein said binder fibers comprise polyolefin fibers.

3. A wiping product as defined in claim 2, wherein said binder fibers contain a material selected from the group consisting of polyethylene and polypropylene .

4. A wiping product as defined in claim 1, wherein said binder fibers comprise bicomponent fibers.

5. A wiping product as defined in claim 1, wherein a pattern is embossed on at least one surface of said web.

6. A wiping product as defined in claim 1, wherein said binder fibers are thermally bonded at a temperature of between about 290° F. to about 325° F.

7. A wiping product as defined in claim 1, wherein said binder fibers are thermally bonded by impact with a creping blade while the web is adhered to a creping surface that simultaneously heats said web to a temperature above the softening temperature of said binder fibers but at a temperature insufficient to melt said binder fibers.

8. A wiping product as defined in claim 1, wherein the basis weight of the wiping product is between about 15 pounds per 2,880 square feet to about 100 pounds per 2,880 square feet.

9. A wiping product as defined in claim 1, wherein said binder fibers constitute between about 10% to about 60% by weight of said web.

10. A wiping product as defined in claim 1, wherein said binder fibers constitute between about 10% to about 40% by weight of said web.

11. A wiping product having a basis weight between about 15 pounds per 2,880 square feet to about 100 pounds per 2,880 square feet, said wiping product comprising:

a creped, stratified web of material that includes an inner fibrous layer positioned between a first outer fibrous layer and a second outer fibrous layer, said web containing pulp fibers and thermally bonded binder fibers, said binder fibers being present in at least said first and said second outer layers so that said binder fibers constitute between about 10% to about 40% by weight of said web, said web being formed without using a creping adhesive.

12. A wiping product as defined in claim 11, wherein said binder fibers comprise polyolefin fibers.

13. A wiping product as defined in claim 12, wherein said binder fibers contain a material selected from the group consisting of polyethylene and polypropylene.

14. A wiping product as defined in claim 11, wherein said binder fibers comprise bicomponent fibers.

15. A wiping product as defined in claim 11, wherein a pattern is embossed on at least one surface of said web.

16. A wiping product as defined in claim 11, wherein said binder fibers are thermally bonded at a temperature of between about 290° F. to about 325° F.

17. A wiping product as defined in claim 11, wherein said binder fibers are thermally bonded by impact with a creping blade while the web is adhered to a creping surface that simultaneously heats said web to a temperature above the softening temperature of said binder fibers but at a temperature insufficient to melt said binder fibers.

* * * * *